US006316924B1

(12) United States Patent
Stapleton et al.

(10) Patent No.: US 6,316,924 B1
(45) Date of Patent: Nov. 13, 2001

(54) SUPPLY VOLTAGE SEQUENCING CIRCUIT

(75) Inventors: Michael A. Stapleton, Portland; Bernard W. Boland, Hillsboro; Jeffery J. Olsen, Banks; John A. Dickerson, Hillsboro, all of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/606,895

(22) Filed: Jun. 29, 2000

(51) Int. Cl.[7] ..... G05F 1/40
(52) U.S. Cl. ..... 323/273
(58) Field of Search ..... 323/266, 268, 323/270, 271, 273, 274, 282, 284

(56) References Cited

U.S. PATENT DOCUMENTS 4,811,236 * 3/1989 Brennen et al. ..... 364/483
5,617,012 * 4/1997 Murakami ..... 323/207
5,977,660 * 11/1999 Mandalakas et al. ..... 307/105

* cited by examiner

*Primary Examiner*—Matthew Nguyen
(74) *Attorney, Agent, or Firm*—Trop, Pruner & Hu, P.C.

(57) ABSTRACT

A system includes a first power supply line that is associated with a first voltage level and a second power supply line that is associated with a second voltage level. A power supply is coupled to the first and second power lines to establish a first voltage of the first power supply line near the first voltage level and a second voltage of the second power supply line near the second voltage level. The power supply has a response during a time period after the activation or deactivation of the power supply in which the power supply does not maintain a difference between the first and second voltages within a predefined range. The system includes a circuit that is coupled to the first and second power supply lines to maintain the difference between the first and second voltages within the predefined range during the time period.

30 Claims, 5 Drawing Sheets

SUPPLY VOLTAGE SEQUENCING CIRCUIT

BACKGROUND

The invention generally relates to a supply voltage sequencing circuit.

A typical computer system includes a power supply that provides and regulates various supply voltages that are used by and power the components of the computer system. As examples, the computer system may provide and regulate supply voltages for 5 volt (V), 3.3 V, 2.5 V, 1.8 V and 1.5V power planes (also called rails or voltage supply lines) of the computer system.

The power supply does not instantly provide the supply voltages during startup of the computer system. Rather the power supply generally has a transient response that establishes a delay in initially providing, or bringing up, the supply voltages when the computer system is turned on. Furthermore, the power supply may provide some of the supply voltages before others. For example, the power supply may generate a 3.3 V supply voltage for one power plane and further convert the 3.3 V supply voltage to a 1.8 V supply voltage for another power plane. In this manner, there may be a significant delay between when the power supply brings up the 3.3 V supply voltage (that comes up first) and when the power supply brings up the 1.8 V supply voltage. For example, this delay may be attributable to the power supply using a control voltage to convert the 3.3 V supply voltage to the 1.8 V supply voltage, and the power supply may have to wait on the control voltage to come up before the conversion of the 3.3 V supply voltage into the 1.8 V supply voltage takes place. Delays may also exist in the timing in which the power supply removes, or brings down, the supply voltages when the computer system powers down.

A component of the computer system may have a requirement that two power supply voltages that are received by the component must remain within a predefined voltage difference, even during the startup and power down of the computer system. Otherwise, damage to the component may occur.

One possible solution to this problem is to use a converter that does not use a control voltage to convert one supply voltage into another supply voltage. However, such a converter typically is substantially more expensive to make than a converter that uses the control voltage. Another solution may be to use a string of serially coupled diodes to create a voltage drop from one supply voltage to generate another supply voltage. However, a drawback of this solution is that the forward voltage drop of the diodes must be closely controlled in an environment where a variety of different currents may be drawn. Otherwise, the voltage difference specification may be exceeded. Another solution may be to couple the sensitive components to the plane that the supply voltage that appears at an earlier time only after sensing the presence of the supply voltage that appears at a later time. However, switching circuits to selectively couple the components to the power plane must have a low resistance, thereby making this design difficult to implement.

Thus, there is a continuing need for an arrangement that addresses one or more of the problems that are stated above.

DETAILED DESCRIPTION

Figure 1:
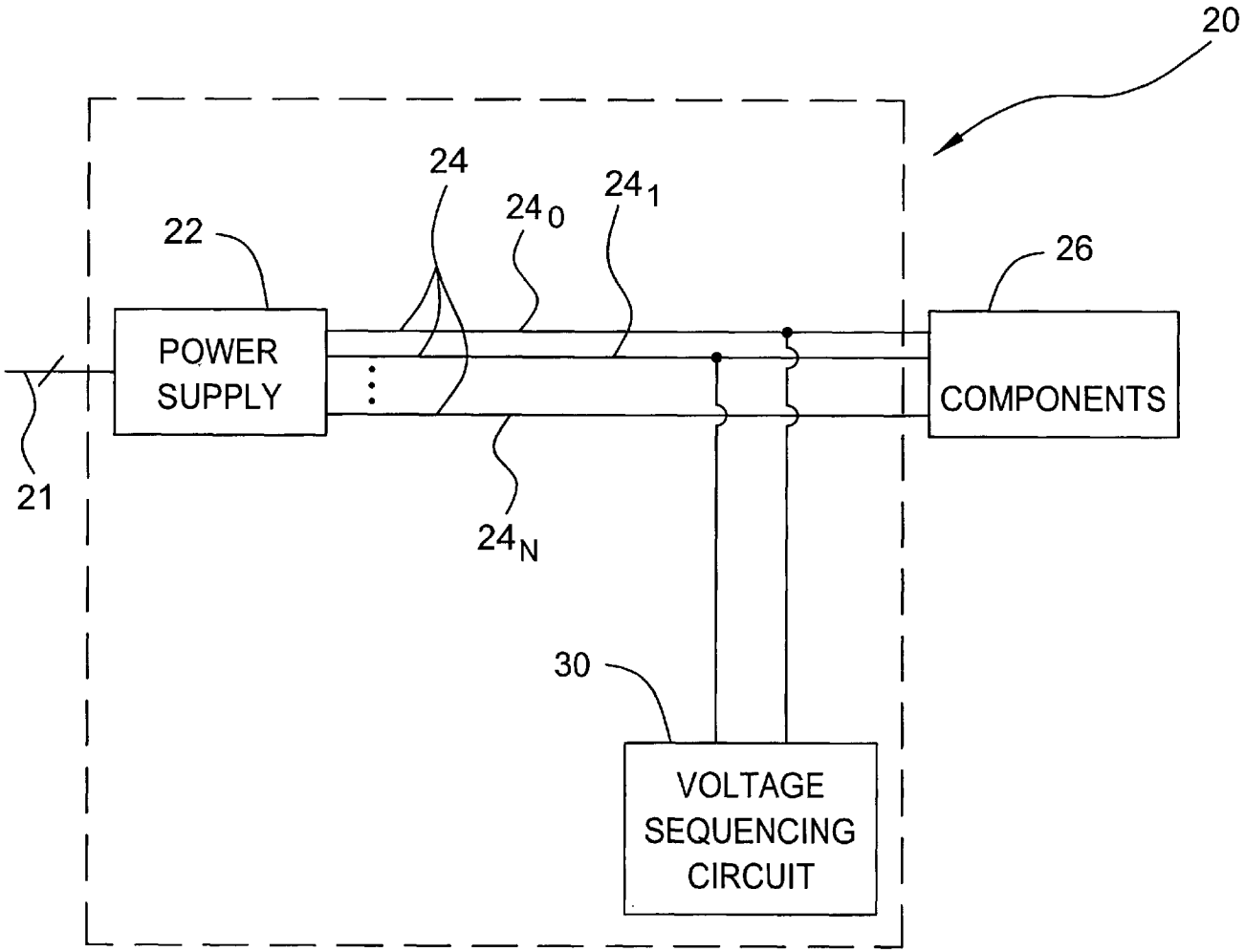
FIG. 1 is a schematic diagram of a power system according to an embodiment of the invention.

Referring to FIG. 1, an embodiment 20 of a power supply system in accordance with the invention includes a power supply 22 to provide different supply voltages to voltage supply rails 24 (rails $\mathbf{24}_0$, $\mathbf{24}_1$, . . . $\mathbf{24}_N$ shown as examples), that extend to and are coupled to various power consuming components 26. The term "voltage supply rail" may alternatively be referred to as a power supply plane or a power supply line. Besides the power supply 22, the power supply system 20 includes a voltage sequencing circuit 30 to maintain a voltage difference between at least two of the rails 24 within a predefined range, including time intervals in which the power supply 22 powers up or down. In the following description, the voltage sequencing circuit 30 is described as maintaining a voltage difference between the two rails $\mathbf{24}_0$ and $\mathbf{24}_1$ within a predefined range for purposes of simplifying the description. However, the voltage sequencing circuit 30, in some embodiments of the invention, may maintain predefined voltage differences between more than two of the rails 24 and/or between rails 24 other than the rails $\mathbf{24}_0$ and $\mathbf{24}_1$.

More specifically, in some embodiments of the invention, the power supply 22 may receive an AC wall voltage (via input lines 21) and convert the AC wall voltage into DC supply voltages that appear on the rails 24. Due to the technique that is used to generate the DC supply voltages, when the power supply 22 is first turned on, or activated, the power supply 22 may initially provide, or bring up, the supply voltage on one of the rails 24 before bringing up the supply voltage on another one of the rails 24. For example, the power supply 22 may convert the supply voltage on the rail $\mathbf{24}_0$ into a lower supply voltage that the power supply 22 furnishes to the rail $\mathbf{24}_1$. In this conversion, the power supply 22 may use a control voltage, a voltage that also has a transient response after the power supply 22 is first turned on. Therefore, a substantial difference in time may exist between a time when the power supply 22 brings up the supply voltage on the rail $\mathbf{24}_0$ and a time when the power supply 22 subsequently brings up the supply voltage on the rail $\mathbf{24}_1$. Similarly, delays may exits when the power supply 22 is turned off, or deactivated, as described below.

For purposes of a voltage difference between the rails $\mathbf{24}_0$ and $\mathbf{24}_1$ within a predefined range during the power up of the power supply 22, the power down of the power supply 22 and/or other times when the voltage difference falls outside of the predefined range, the voltage sequencing circuit 30 is enabled before the voltage difference falls outside of the predefined range. In this manner, the voltage sequencing circuit 30, in some embodiments of the invention, includes a linear voltage regulation circuit that, when enabled, receives the supply voltage from the rail $\mathbf{24}_0$, converts this supply voltage into a generally proportional supply voltage, and furnishes this converted voltage to the rail $\mathbf{24}_1$. When the voltage difference is well within the predefined range, the voltage sequencing circuit 30 disables itself to permit the power supply 22 to take over the regulation and generation of the supply voltages. Because after power up (for example) the voltage sequencing circuit 30 has a substantially faster response in bringing up its supplied voltage than the power supply 22, the circuit 30 maintains the predefined voltage difference between the rails $\mathbf{24}_0$ and $\mathbf{24}_1$ until the power supply 22 brings the voltage of the rail $\mathbf{24}_1$ up to the appropriate level.

The supply voltage that the voltage sequencing circuit 30 furnishes to the rail $\mathbf{24}_1$, in some embodiments of the invention, is slightly below the appropriate supply voltage for the rail $\mathbf{24}_1$. However, the supply voltage that the voltage sequencing circuit 30 provides to the rail $\mathbf{24}_1$ is a voltage that maintains the voltage difference between the rails $\mathbf{24}_0$ and $\mathbf{24}_1$ within the predefined range. In some embodiments of the invention, once the power supply 22 brings the voltage of the rail $\mathbf{24}_1$ near the voltage that is supplied by the voltage sequencing circuit 30, the circuit 30 is disabled until an event occurs (a power off or a severe transient condition occurs, for example) that causes the voltage that is provided by the power supply 22 to the rail $\mathbf{24}_1$ to drop below the voltage that would be provided by the voltage sequencing circuit 30 to the rail $\mathbf{24}_1$. Thus, upon the occurrence of this event, the voltage sequencing circuit 30 is enabled to maintain the voltage difference within the predefined range.

As a more specific example, after the power supply 22 has fully brought up the supply voltages on the rails, the rail $\mathbf{24}_0$ may have a voltage of approximately 3.3 V, and the rail $\mathbf{24}_1$ may have a voltage of approximately 1.8 V. As an example, one of the components 26 that receives power from the rails $\mathbf{24}_0$ and $\mathbf{24}_1$ may require that the voltage difference between the rails $\mathbf{24}_0$ and $\mathbf{24}_1$ does not exceed 2.0 V, thereby establishing the predefined range of 2.0 V. Otherwise, a voltage difference outside of the 2.0 V range may damage this component 26. Continuing the example, at powerup of the power supply 22, the power supply 22 first furnishes the 3.3 V supply voltage to the rail $\mathbf{24}_0$. However, because of the delay that is associated with generating the 1.8 V supply voltage, the power supply 22 does not immediately provide a voltage to the rail $\mathbf{24}_1$ within 2.0 V of the voltage of the rail $\mathbf{24}_0$. In this manner, although the power supply 22 is not providing a sufficient voltage to the rail $\mathbf{24}_1$, the voltage sequencing circuit 30 pulls the voltage of the rail $\mathbf{24}_1$ up to approximately 1.6 volts, i.e., 200 millivolts (mV) below the 1.8 V threshold but well within the 2.0 V range. Eventually, the power supply 22 brings the voltage it supplies to the rail $\mathbf{24}_1$ up to 1.6 V. At this point, the voltage sequencing circuit 30 is disabled to allow the power supply 22 to subsequently bring the voltage of the rail $\mathbf{24}_1$ near 1.8 V and regulate the voltage of the rail $\mathbf{24}_1$ thereafter.

In the example above, the voltages and voltage range are given for purposes of clarifying operating of the power system 20. Other voltages and voltage ranges may be used in other embodiments of the invention.

The ability of the voltage sequencing circuit 30 to quickly generate the supply voltage for the rail $\mathbf{24}_1$ may be attributable to its use of a linear-type voltage regulator to generate a voltage that is proportional to the supply voltage that is present on the rail $\mathbf{24}_0$. Thus, unlike the power supply 22 that uses a switching-type voltage regulator, or converter, to convert the supply voltage of the rail $\mathbf{24}_0$ using a control voltage, the voltage sequencing circuit 30 produces the supply voltage of the rail $\mathbf{24}_1$ directly from the supply voltage of the rail $\mathbf{24}_0$. Therefore, the voltage sequencing circuit 30 may bring up its supplied voltage for the rail $\mathbf{24}_1$ much more rapidly than the power supply 22. The power supply 22 is generally a more efficient and more accurate voltage regulation circuit once the power supply 22 brings up the supply voltages for the rails 24. Therefore, the disabling of the voltage sequencing circuit 30 takes advantage of the more power efficient features of the power supply 22.

Thus, the advantages of the above-described arrangement may include one or more of the following. The voltage sequencing circuit 30 may be placed anywhere on a circuit board (a motherboard, for example) where there is free area. The voltage sequencing circuit 30 may provide an inexpensive way to control sequencing between any two power rails. Minimal circuitry may be required. Accurate voltage regulation may still be achieved. Voltage difference specifications may not be exceeded. Other and/or different advantages may be possible in the various embodiments of the invention.

Figure 6:
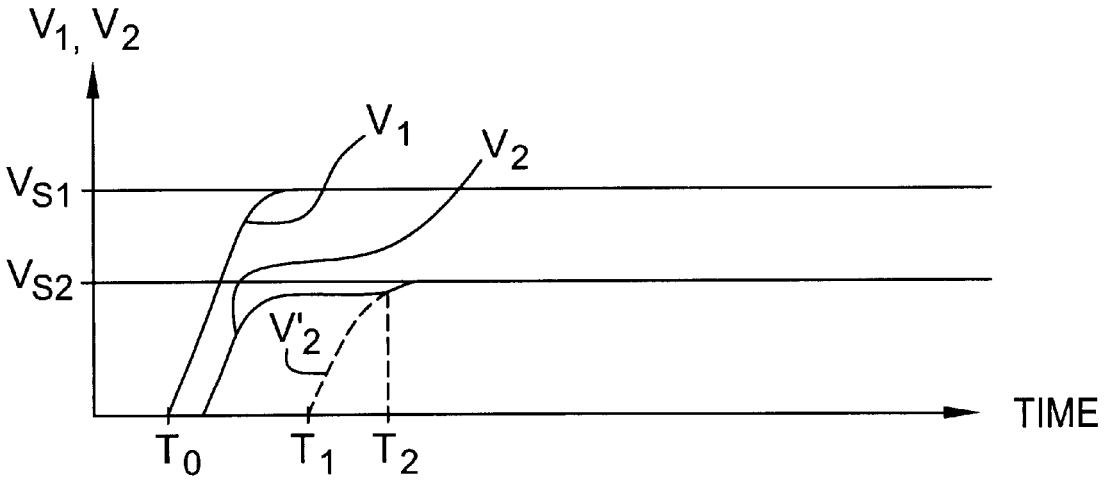
FIG. 6 depicts signals that illustrate operation of the power system of FIG. 1 after a power supply of the power system is turned on according to an embodiment of the invention.

Referring to FIG. 6, in some embodiments of the invention, the voltage sequencing circuit 30 may affect the voltages of the rails 24 in the following manner when the power supply 22 is activated, or turned on, at time $T_0$. In response to being turned on, the power supply 22 begins pulling up a voltage (called $V_1$) of the rail $\mathbf{24}_0$ until the $V_1$ voltage reaches a voltage supply level (called $V_{S1}$) that is associated with the rail $\mathbf{24}_0$. Because of the delay that the power supply 22 may introduce when generating a voltage for the rail $\mathbf{24}_1$, the power supply 22, without the voltage sequencing circuit 30, may bring up a voltage (called $V_2'$) of the rail $\mathbf{24}_1$ beginning at a later time $T_1$. As a result, due to the time period (from time $T_0$ to time $T_1$) that the power supply 22 delays in bringing up the voltage of the rail $\mathbf{24}_1$, the voltage difference between the rails $\mathbf{24}_0$ and $\mathbf{24}_1$ may fall outside of some predefined voltage range (a 2 V range, as an example). However, this does not occur because the voltage sequencing circuit 30 becomes enabled while the power supply 22 is bringing up the $V_1$ voltage. Once enabled, the voltage sequencing circuit 30 establishes a voltage (called $V_2$) for the rail $\mathbf{24}_1$. As depicted in FIG. 6, the voltage sequencing circuit 30 ensures that the $V_2$ voltage is generally proportional to the $V_1$ voltage while the power supply 22 brings up the $V_1$ voltage. At time $T_2$ when the power supply 22 is able to maintain the $V_2$ voltage near (approximately 200 mV below, for example) a voltage level (called $V_{S2}$) that is associated with the rail $\mathbf{24}_1$, the voltage sequencing circuit 30 disables itself so that the power supply 22 may raise the $V_2$ voltage to the $V_{S2}$ level and maintain the $V_2$ voltage at the $V_{S2}$ level.

Figure 7:
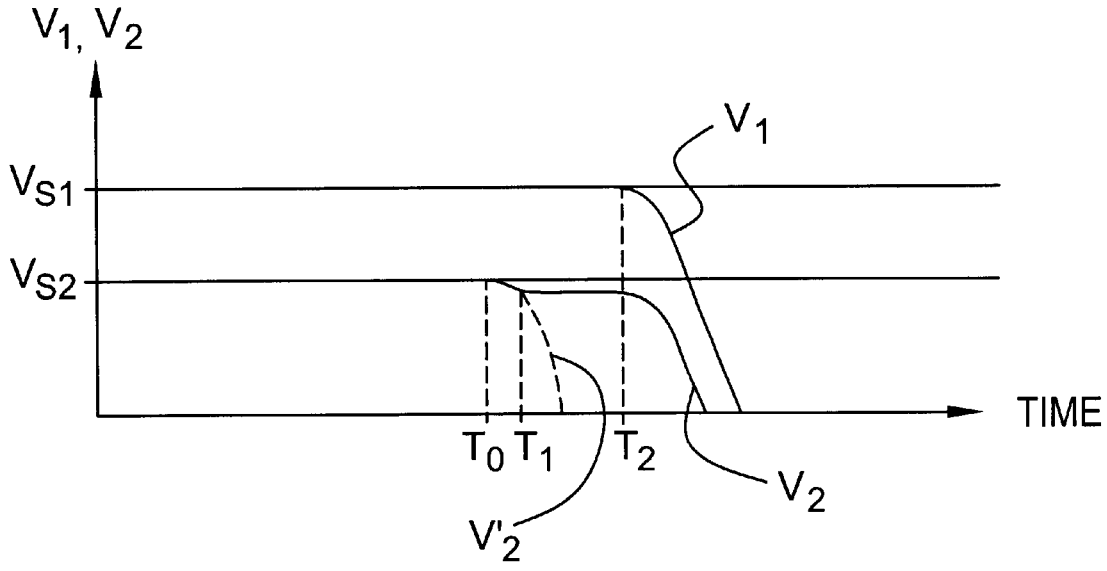
FIG. 7 depicts signals that illustrate operation of the power system of FIG. 1 after the power supply is turned off according to an embodiment of the invention.

Referring to FIG. 7, in some embodiments of the invention, the voltage sequencing circuit 30 may affect the voltages of the rails 24 in the following manner when the power supply 22 is deactivated, or turned off, at time $T_0$. In response to being turned on, the power supply 22 may initially allow the voltage of the rail $\mathbf{24}_1$ to fall, as depicted by a voltage called V1', because the generation of the voltage of the rail $\mathbf{24}_1$ may depend on a control voltage that disappears when the power supply is turned off. Thus, the power supply 22 may drop the $V_1$ voltage at a later time $T_2$. As a result, due to this time period (from time $T_0$ to time $T_2$), the voltage difference between the rails $\mathbf{24}_0$ and $\mathbf{24}_1$ may fall outside of some predefined voltage range. However, this does not occur because the voltage sequencing circuit 30 becomes enabled at time $T_1$ when the voltage of the rail $\mathbf{24}_1$ drops below (200 mV below, for example) the $V_{S2}$ voltage level. Once enabled, the voltage sequencing circuit 30 establishes a voltage (called $V_2$) for the rail $\mathbf{24}_1$. As depicted in FIG. 6, the voltage sequencing circuit 30 ensures that the $V_2$ voltage is generally proportional to the $V_1$ voltage even after time $T_2$ when the power supply 22 allows the $V_1$ voltage of the rail $\mathbf{24}_0$ to fall.

Figure 2:
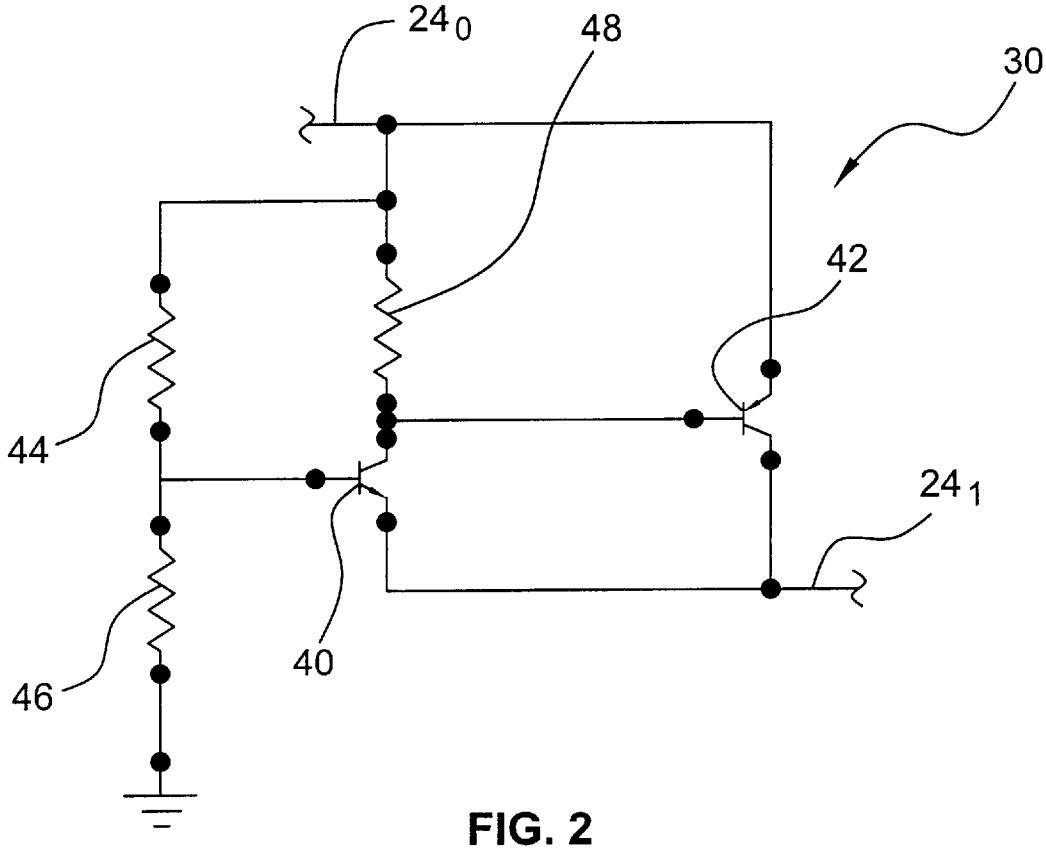
FIGS. 2, 3 and 4 are schematic diagrams of voltage sequencing circuits of the power system of FIG. 1 according to different embodiments of the invention.

FIG. 2 depicts a possible embodiment of the voltage sequencing circuit 30. The circuit 30 includes an NPN bipolar junction transistor 40 that provides the biasing of the circuit 30 and a PNP bipolar junction transistor 42 that functions as a pass transistor to provide current to the rail $\mathbf{24}_1$. The emitter terminal of the transistor 40 is coupled to the rail $\mathbf{24}_1$ to provide the supply voltage to the rail $\mathbf{24}_1$. This supply voltage is established by resistors 44 and 46. The resistor 44 has one terminal that is coupled to the rail $\mathbf{24}_0$, and another terminal of the resistor 44 is coupled to the base terminal of the transistor 40. The resistor 46 is coupled between the base terminal of the transistor 40 and ground.

The circuit 30 also includes a resistor 48 that is coupled between the rail $\mathbf{24}_0$ and the collector terminal of the transistor 40. The base terminal of the transistor 42 is coupled to the collector terminal of the transistor 40; the emitter terminal of the transistor 42 is coupled to the rail $\mathbf{24}_0$; and the collector terminal of the transistor 42 is coupled to the rail $\mathbf{24}_1$. The voltage at the emitter terminal of the NPN transistor 40 (i.e., the voltage at the output of the circuit 30) is equal to the voltage of the base terminal of the NPN transistor 40 less the Vbe voltage drop of the NPN transistor 40.

Due to this arrangement, when the voltage of the rail $\mathbf{24}_1$ is within two p-n junction voltage drops of the voltage of the rail $\mathbf{24}_0$, the voltage sequencing circuit 20 is disabled, as both transistors 40 and 42 are reverse biased. Otherwise, when the voltage of the rail $\mathbf{24}_1$ is less than two p-n junction voltage drops of the voltage of the rail $\mathbf{24}_0$, the voltage sequencing circuit 30 is enabled. Other voltage differences may be established in other embodiments of the invention.

Figure 3:
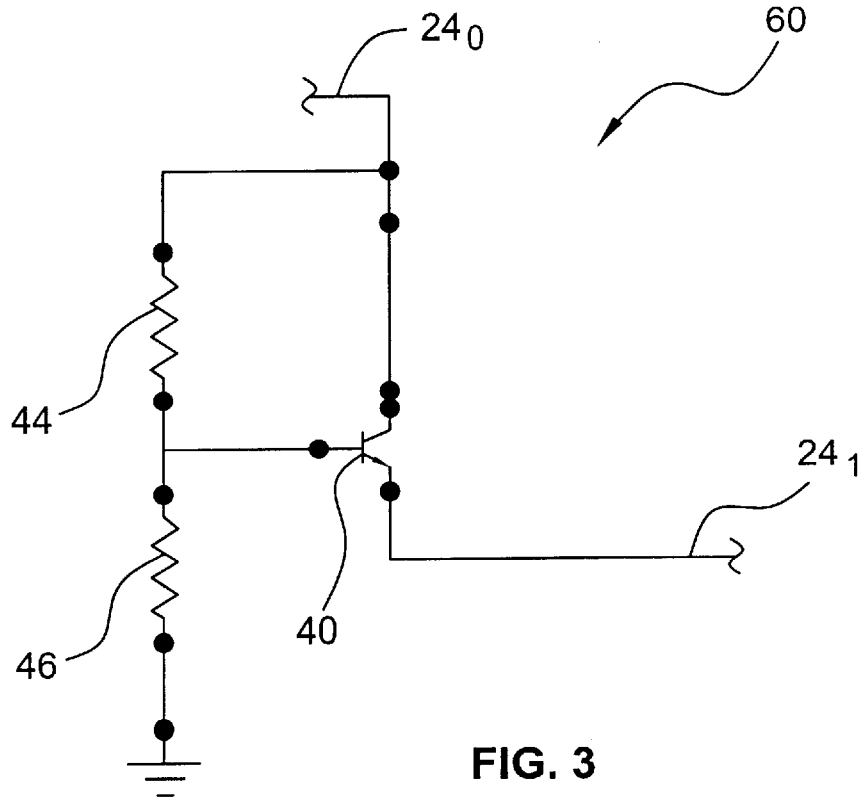

Referring to FIG. 3, in some embodiments of the invention, the voltage sequencing circuit 30 may be replaced by a voltage sequencing circuit 60. The voltage sequencing circuit 30 has a similar design to the voltage sequencing circuit 60, with the differences being pointed out below. In particular, the voltage sequencing circuit 60 does not include the transistor 42. Furthermore, the voltage sequencing circuit 60 does not include the resistor 48. Instead, the collector terminal of the transistor 40 is coupled to the rail $\mathbf{24}_0$. The voltage at the emitter terminal of the NPN transistor 40 (i.e., the voltage at the output of the circuit 60) is equal to the voltage of the base terminal of the NPN transistor 40 less the Vbe voltage drop of the NPN transistor 40.

Figure 4:
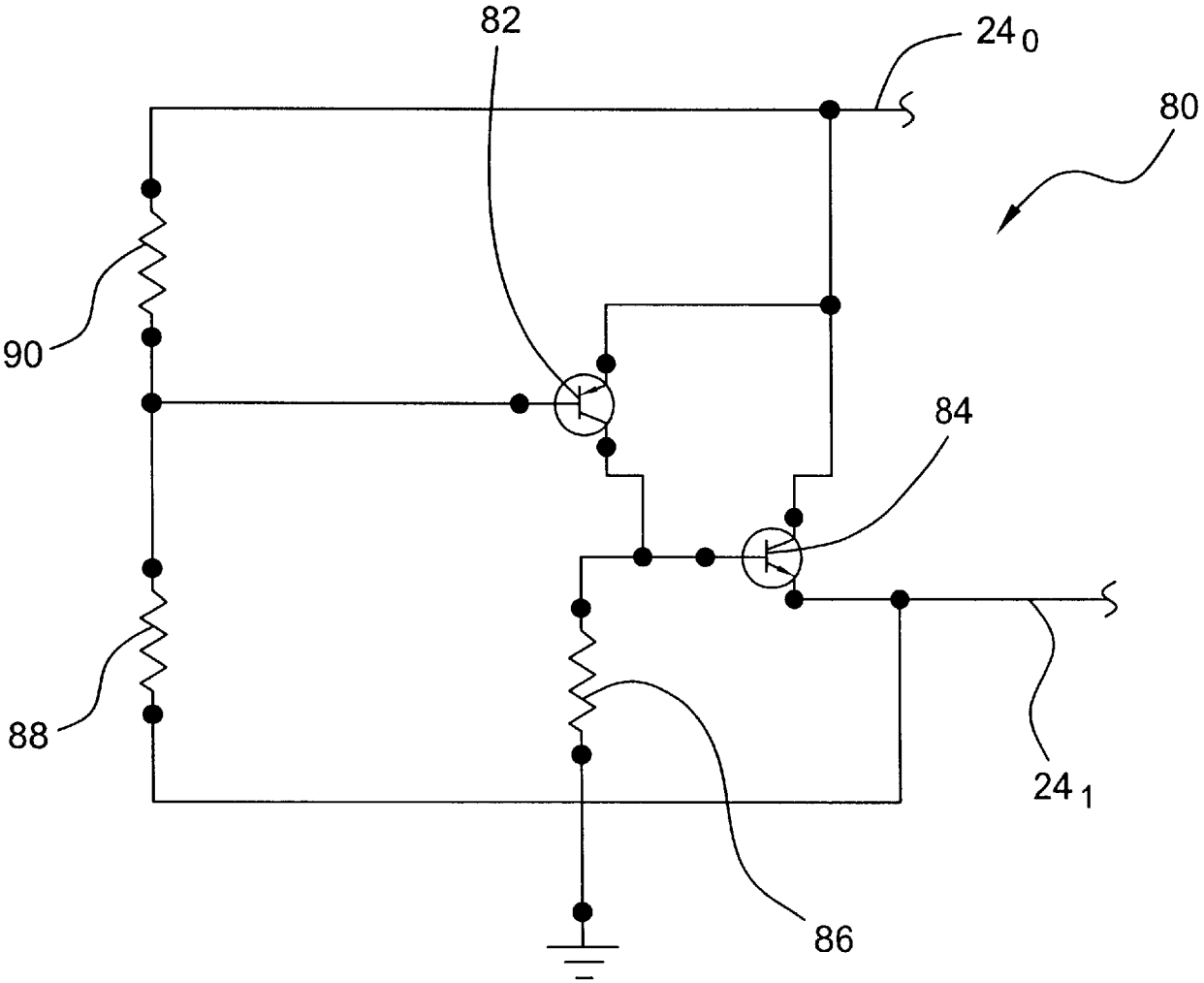

Referring to FIG. 4, in some embodiments of the invention, the voltage sequencing circuits 30 and 60 may be replaced by a voltage sequencing circuit 80. The voltage sequencing circuit 80 includes a PNP bipolar junction transistor 82 that scales the voltage of the rail $\mathbf{24}_0$ to provide the voltage to the rail $\mathbf{24}_1$. The voltage sequencing circuit 80 also includes an NPN bipolar junction transistor 84 that functions as a pass transistor to supply the appropriate level of current to the rail $\mathbf{24}_1$. The emitter terminal of the transistor 82 is coupled to the rail $\mathbf{24}_0$, and the base terminal of the transistor 82 is coupled to one terminal of a resistor 90 of the voltage sequencing circuit 80. The other terminal of the resistor 90 is coupled to the rail $\mathbf{24}_0$. The voltage sequencing circuit 80 also includes a resistor 88 that is coupled between the base terminal of the transistor 82 and ground and a resistor 86 that is coupled between the collector terminal of the transistor 82 and ground. The base terminal of the transistor 84 is coupled to the collector terminal of the transistor 82; the collector terminal of the transistor 82 is coupled to the rail $\mathbf{24}_0$; and the emitter terminal of the transistor 84 is coupled to the rail $\mathbf{24}_1$. The voltage at the emitter terminal of the NPN transistor 84 (i.e., the voltage at the output of the circuit 80) is equal to the voltage of the base terminal of the NPN transistor 84 less the Vbe voltage drop of the NPN transistor 84.

Due to this arrangement, when the voltage of the rail $\mathbf{24}_1$ is within two p-n junction voltage drops of the voltage of the rail $\mathbf{24}_0$, the voltage sequencing circuit 80 is disabled, as both transistors 82 and 84 are reverse biased. Otherwise, when the voltage of the rail $\mathbf{24}_1$ is less than two p-n junction voltage drops of the voltage of the rail $\mathbf{24}_0$, the voltage sequencing circuit 80 is enabled. Other voltage differences may be established in other embodiments of the invention.

Figure 5:
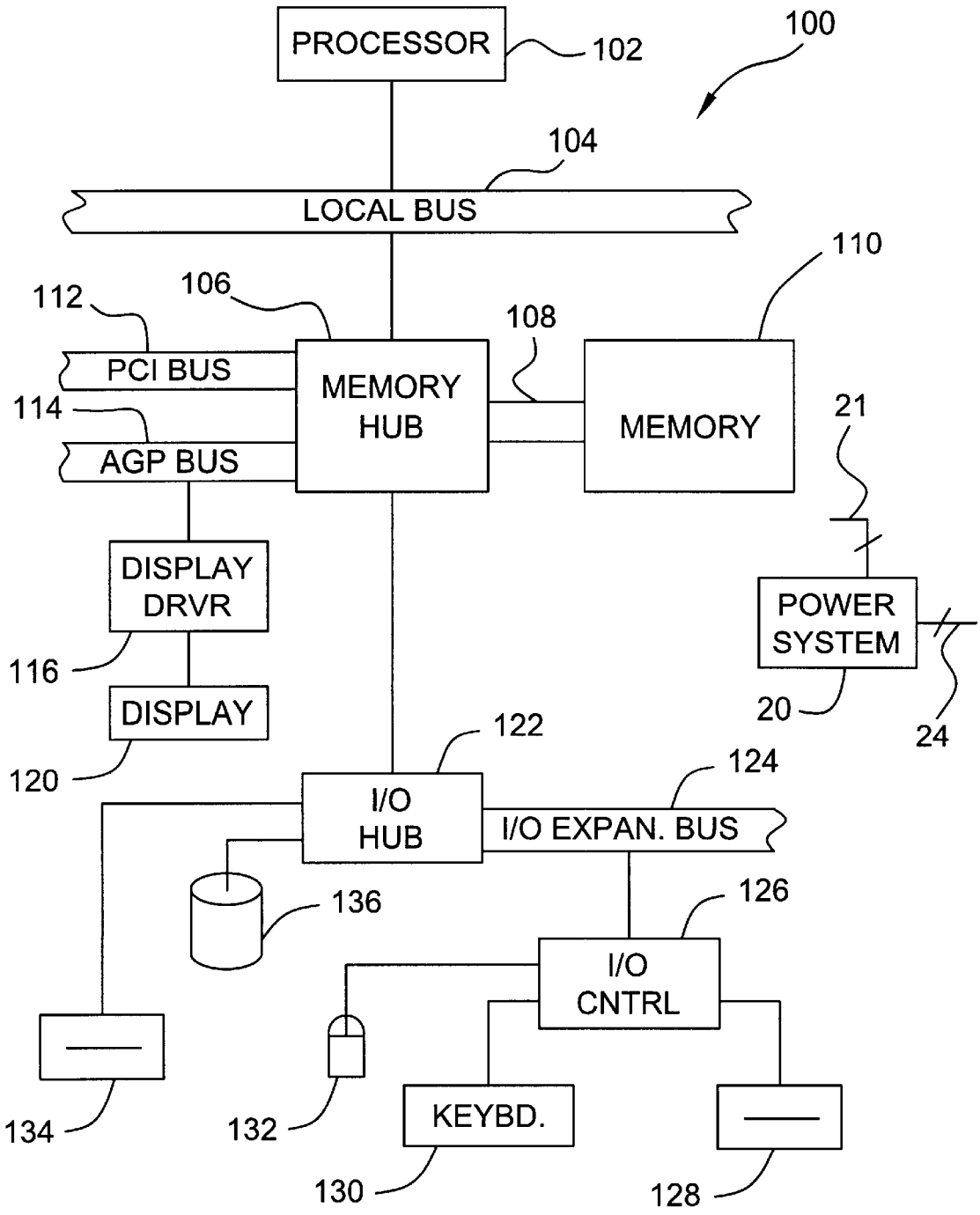
FIG. 5 is a schematic diagram of a computer system according to an embodiment of the invention.

Referring to FIG. 5, in some embodiments of the invention, the power system 20 may be part of a computer system 100 and provide power (via the rails 24) to the various components of the computer system 100. For example, the power subsystem 20 may provide power to a processor 102 of the computer system 100. In this context, the term "processor" may refer to, as examples, to at least one microcontroller, X86 microprocessor, Advanced RISC Machine (ARM) microprocessor or Pentium microprocessor. Other types of processors are possible and are within the scope of the following claims.

The computer system 100 includes the following other components that are powered by the power system 20. For example, the processor 102 is coupled to a local bus 104 along with a north bridge, or memory hub 106. The memory hub 106 provides interfaces to a Peripheral Component Interconnect (PCI) bus 112 and an Accelerated Graphics Port (AGP) bus 114. The PCI Specification is available from The PCI Special Interest Group, Portland, Oreg. 97214. The AGP is described in detail in the Accelerated Graphics Port Interface Specification, Revision 1.0, published on Jul. 31, 1996, by Intel Corporation of Santa Clara, Calif. A display driver 116 may be coupled to the AGP bus 114 and provide signals to drive a display 120. The memory hub 106 also provides an interface to a memory bus 108 that is coupled to system memory 110.

A south bridge, or input/output (I/O) hub 122, is coupled to the memory hub 106. The I/O hub 122 provides interfaces for a hard disk drive 136, a CD-ROM drive 134 and an I/O expansion bus 124, as just a few examples. An I/O controller 126 may be coupled to the I/O expansion bus 124 to receive input data from a mouse 132 and a keyboard 130. The I/O controller 126 may also control operations of a floppy disk drive 128.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A system comprising:

a first power supply line associated with a first voltage level;

a second power supply line associated with a second voltage level;

a power supply being coupled to the first and second power lines to establish a first voltage of the first power supply line near the first voltage level and a second voltage of the second power supply line near the second voltage level, the power supply having a response during a time period after the activation or deactivation of the power supply in which the power supply does not maintain a difference between the first and second voltages within a predefined range; and a circuit coupled to the first and second power supply lines to maintain the difference between the first and second voltages within the predefined range during the time period.

2. The system of claim 1, wherein the circuit comprises:

a voltage regulator to maintain the difference within the predefined range.

3. The system of claim 2, wherein the voltage regulator comprises a linear voltage regulator.

4. The system of claim 2, wherein the voltage regulator is disabled when the difference decreases below a threshold voltage.

5. The system of claim 2, wherein the voltage regulator comprises:

a biasing transistor to provide the second voltage in response to the first voltage; and a pass transistor coupled to the biasing transistor to furnish current to the second power supply line.

6. The system of claim 5, wherein the biasing transistor comprises an NPN bipolar junction transistor, and the pass transistor comprises a PNP bipolar junction transistor.

7. The system of claim 5, wherein the biasing transistor comprises a PNP bipolar junction transistor, and the pass transistor comprises an NPN bipolar junction transistor.

8. The system of claim 5, further comprising:

at least one resistor coupled to the biasing transistor to establish the second voltage.

9. The system of claim 2, wherein the voltage regulator comprises:

a transistor to provide the second voltage in response to the first voltage and furnish current to the second power supply line.

10. The system of claim 1, further comprising:

a microprocessor to receive power from at least one of the first and second power supply lines.

11. A system comprising:

a first power supply line associated with a first voltage level;

a second power supply line associated with a second voltage level;

a power supply being coupled to the first and second power lines to establish a first voltage of the first power supply line near the first voltage level and a second voltage of the second power supply line near the second voltage level, the power supply having a response during a time period after the activation of the power supply in which the power supply does not maintain a difference between the first and second voltages within a predefined range; and a circuit coupled to the first and second power supply lines to maintain the difference between the first and second voltages within the predefined range during the time period.

12. The system of claim 11, wherein the circuit comprises:

a voltage regulator to maintain the difference within the predefined range.

13. The system of claim 12, wherein the voltage regulator comprises a linear voltage regulator.

14. The system of claim 12, wherein the voltage regulator is disabled when the difference decreases below a threshold voltage.

15. The system of claim 12, wherein the voltage regulator comprises:

a biasing transistor to provide the second voltage in response to the first voltage; and a pass transistor coupled to the biasing transistor to furnish current to the second power supply line.

16. The system of claim 15, further comprising:

at least one resistor coupled to the biasing transistor to establish the second voltage.

17. The system of claim 12, wherein the voltage regulator comprises:

a transistor to provide the second voltage in response to the first voltage and furnish current to the second power supply line.

18. The system of claim 11, further comprising:

a microprocessor to receive power from at least one of the first and second power supply lines.

19. A system comprising:

a first power supply line associated with a first voltage level;

a second power supply line associated with a second voltage level;

a power supply being coupled to the first and second power lines to establish a first voltage of the first power supply line near the first voltage level and a second voltage of the second power supply line near the second voltage level, the power supply having a response during a time period after the deactivation of the power supply in which the power supply does not maintain a difference between the first and second voltages within a predefined range; and a circuit coupled to the first and second power supply lines to maintain the difference between the first and second voltages within the predefined range during the time period.

20. The system of claim 19, wherein the circuit comprises:

a voltage regulator to maintain the difference within the predefined range.

21. The system of claim 20, wherein the voltage regulator comprises a linear voltage regulator.

22. The system of claim 20, wherein the voltage regulator is disabled when the difference decreases below a threshold voltage.

23. The system of claim 20, wherein the voltage regulator comprises:

a biasing transistor to provide the second voltage in response to the first voltage; and a pass transistor coupled to the biasing transistor to furnish current to the second power supply line.

24. The system of claim 23, further comprising:

at least one resistor coupled to the biasing transistor to establish the second voltage.

25. The system of claim 20, wherein the voltage regulator comprises:

a transistor to provide the second voltage in response to the first voltage and furnish current to the second power supply line.

26. The system of claim 19, further comprising:

a microprocessor to receive power from at least one of the first and second power supply lines.

27. A method usable with a computer system, comprising:

using a power supply to establish a first voltage of a first power supply line near a first voltage level and a second voltage of a second power supply line near a second voltage level, the power supply having a response during a time period after the activation or deactivation of the power supply in which the power supply does not maintain a difference between the first and second voltages within a predefined range; and coupling an auxiliary circuit to the first and second power supply lines to maintain the difference between the first and second voltages within the predefined range during the time period.

28. The method of claim 27, further comprising:

decoupling the circuit from the first and second power supply lines in response to the power supply maintaining the difference within the predefined range.

29. The method of claim 27, further comprising:

using the first and second power lines to furnish power to components of the computer system.

30. The method of claim 27, wherein the coupling the auxiliary circuit comprises:

activating a linear voltage regulator.

* * * * *